US009124030B1

(12) United States Patent
Chiu et al.

(10) Patent No.: US 9,124,030 B1
(45) Date of Patent: Sep. 1, 2015

(54) WATERPROOF CONNECTOR DEVICE AND ASSEMBLY THEREOF

(71) Applicant: GT CONTACT CO., LTD., New Taipei (TW)

(72) Inventors: Jui-Jung Chiu, Taoyuan County (TW); Chien-Chung Chiu, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 0 days.

(21) Appl. No.: 14/311,415

(22) Filed: Jun. 23, 2014

(51) Int. Cl.
*H01R 13/627* (2006.01)
*H01R 4/36* (2006.01)
*H01R 13/52* (2006.01)

(52) U.S. Cl.
CPC ..... *H01R 13/6275* (2013.01); *H01R 4/36* (2013.01); *H01R 13/5219* (2013.01)

(58) Field of Classification Search
CPC ..... H01R 13/6275
See application file for complete search history.

(56) References Cited

U.S. PATENT DOCUMENTS

| | | | | |
|---|---|---|---|---|
| 3,544,951 | A * | 12/1970 | Roberts | 439/358 |
| 4,508,407 | A * | 4/1985 | Ball | 439/312 |
| 4,917,625 | A * | 4/1990 | Haile | 439/358 |
| 5,180,312 | A * | 1/1993 | Martin | 439/78 |
| 6,648,681 | B2 * | 11/2003 | Ushiro et al. | 439/557 |
| 6,840,805 | B2 * | 1/2005 | Cech et al. | 439/598 |
| 7,387,525 | B1 * | 6/2008 | Huang | 439/352 |
| 8,092,246 | B1 * | 1/2012 | Santiago | 439/357 |
| 8,591,268 | B2 * | 11/2013 | Reimchen | 439/701 |
| 2012/0237288 | A1 * | 9/2012 | Sczesny | 403/322.4 |
| 2015/0044913 | A1 * | 2/2015 | Chen | 439/676 |

* cited by examiner

*Primary Examiner* — James Harvey
(74) *Attorney, Agent, or Firm* — Li & Cai Intellectual Property (USA) Office

(57) ABSTRACT

A waterproof connector device includes a plug connector and a snap ring. The plug connector has a plug main body and a plurality of conductive terminals. The plug main body has a plugging column and a retaining portion extending from the bottom edge of the plugging column. The conductive terminals are disposed in the plug main body, and are inserted in the plugging column and partially exposed from the plugging column. The snap ring has an annular main body, a plurality of first snap arms and a plurality of second snap arms. The directions of extensions of the first snap arms and the second snap arms are substantially opposite. By this configuration, the first snap arms can detachably pass through the retaining portion for fixing the relative position of the snap ring and the plug connector. Additionally, the present disclosure also provides a waterproof connector device assembly.

10 Claims, 15 Drawing Sheets

WATERPROOF CONNECTOR DEVICE AND ASSEMBLY THEREOF

BACKGROUND OF THE INVENTION

1. Field of the Invention

The present disclosure relates to a connector device; in particular, to a waterproof connector device and an assembly thereof.

2. Description of Related Art

Connectors are currently widely applied on different types of electronic devices and electric devices such that users can use connector devices as units to quickly send data, signals and electric power. Connector devices can increase the speed of data transmission, such that people's life can become more convenient.

Connector devices typically include plug connectors and socket connectors, and are usually exposed to the ambience. The terminal of a connector device serves as a contact end for electrical connection. Therefore, when the connector device is placed outdoors or in environments with high amount of water vapor, water vapor seeps therein, or the plug connector and the socket connector cannot be securely engaged due to repeated use, thereby affecting the transmission ability and life span.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a waterproof connector device whose plug connector and socket connector can keep their relative positions without separating through engagement of a snap ring.

In order to achieve the aforementioned objects, the present disclosure provides a waterproof device including: a plug connector including: a plug main body which has a plugging column and a retaining portion extending integrally as one body from the bottom edge of the plugging column, wherein the retaining portion has a front surface proximal to the plugging column and a rear surface distal from the plugging column, and a plurality of through holes passing through the front surface and the rear surface is formed on the retaining portion; and a plurality of conductive terminals disposed in the plug main body, wherein the conductive terminals are partially inserted in the plugging column and partially exposed outside the plugging column; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, and the quantity of the first snap arms is not greater than the quantity of the through holes of the retaining portion; wherein the first snap arms of the snap ring can individually pass through the through holes of the retaining portion from the front surface thereof, and abut the rear surface of the retaining portion for fixing the relative position of the snap ring to the plug connector, and the height of the second snap arms with respect to the front surface is not greater than the height of the plugging column with respect to the front surface.

The present disclosure provides another type of waterproof connector device including: a socket connector including: a socket main body which has a plugging slot and a retaining portion extending integrally as one body from the front edge of the plugging slot, wherein the retaining portion has a front surface proximal to the plugging slot and a rear surface distal from the plugging slot, and a plurality of through holes passing through the front surface and the rear surface is formed on the retaining portion; and a plurality of conductive terminals disposed in the socket main body, wherein the conductive terminals are partially inserted in the plugging slot; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, and the quantity of the second snap arms is not greater than the quantity of the through holes of the retaining portion; wherein the second snap arms of the snap ring can individually pass through the through holes of the retaining portion from the front surface thereof, and abut the rear surface of the retaining portion for fixing the relative position of the snap ring to the socket connector.

The present disclosure further provides a waterproof connector device assembly including: a plug connector including: a plug main body which has a plugging column and a retaining portion extending integrally as one body from the bottom edge of the plugging column, wherein the retaining portion has a front surface proximal to the plugging column and a rear surface distal from the plugging column, and a plurality of through holes passing through the front surface and the rear surface is formed on the retaining portion; and a plurality of conductive terminals disposed in the plug main body, wherein the conductive terminals are partially inserted in the plugging column and partially exposed outside the plugging column; a socket connector including: a socket main body which has a plugging slot and a retaining portion extending integrally as one body from the front edge of the plugging slot, wherein the retaining portion has a front surface proximal to the plugging slot and a rear surface distal from the plugging slot, and a plurality of through holes passing through the front surface and the rear surface is formed on the retaining portion; and a plurality of conductive terminals disposed in the socket main body, wherein the conductive terminals are partially inserted in the plugging slot; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, the quantity of the first snap arms is not greater than the quantity of the through holes of the plug connector, and the quantity of the second snap arms is not greater than the quantity of the through holes of the socket connector; wherein the first snap arms and the second snap arms of the snap ring can respectively engage the retaining portion of the plug connector and the retaining portion of the socket connector, the first snap arms pass through the through holes of the plug main body from the front surface thereof, the second snap arms pass through the through holes of the socket main body from the front surface thereof, the first snap arms abut the rear surface of the plug main body, the second snap arms abut the rear surface of the socket main body, such that the relative position of the plug connector and the socket connector is fixed and the plugging column of the plug connector is connected to the plugging slot of the socket connector for achieving electrical connection.

The present disclosure has the following advantages. The waterproof connector device of the present disclosure has a snap ring whose first snap arms can individually engage the retaining portion of the plug connector for fixing the relative position of the snap ring to the plug connector. The waterproof connector device of the present disclosure has a snap ring whose second snap arms can individually engage the retaining portion of the socket connector for fixing the relative position of the snap ring to the socket connector. The waterproof connector device assembly of the present disclosure has a snap ring whose first snap arms and snap arms can individually engage the retaining portion of the plug connector and the retaining portion of the socket connector, respectively, for fixing the relative position of the plug connector and the socket connector in order to achieve electrical connection.

In order to further the understanding regarding the present disclosure, the following embodiments are provided along with illustrations to facilitate the disclosure of the present disclosure.

DETAILED DESCRIPTION OF THE PREFERRED EMBODIMENTS

First Embodiment

Figure 1:
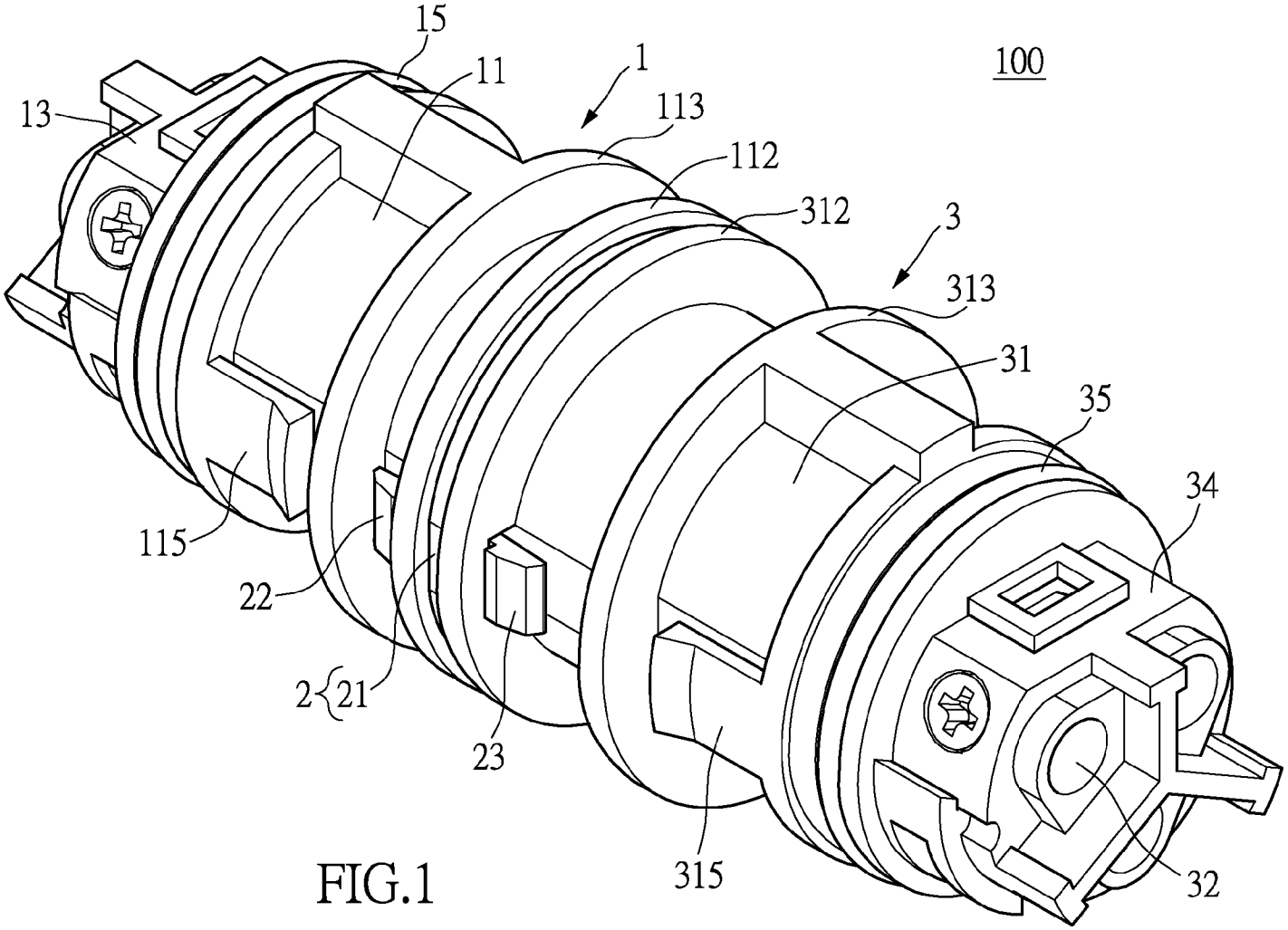
FIG. 1 shows a perspective view of a waterproof connector device assembly according to the present disclosure.
Figure 2:
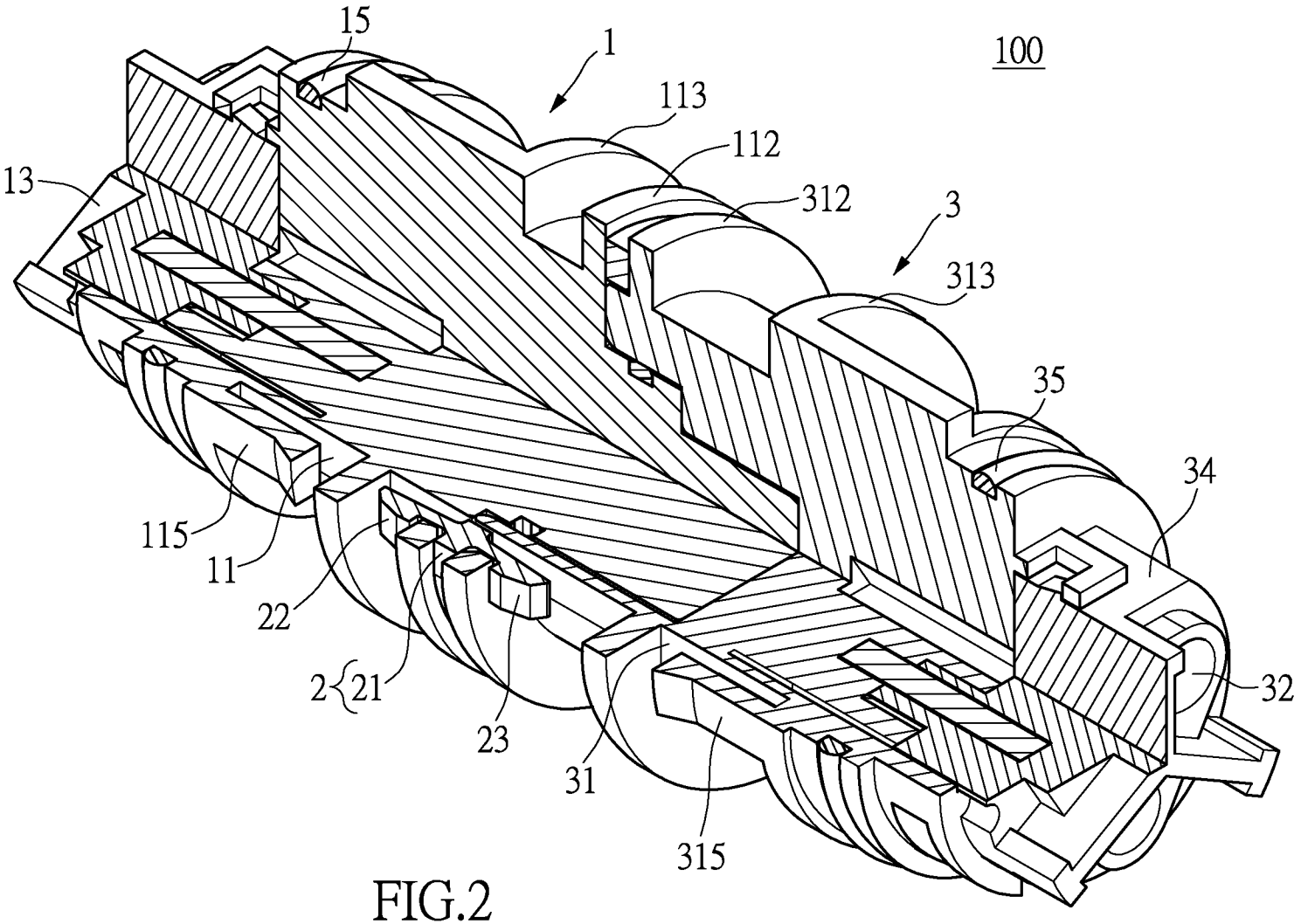
FIG. 2 is a cross-sectional view of FIG. 1.
Figure 3:
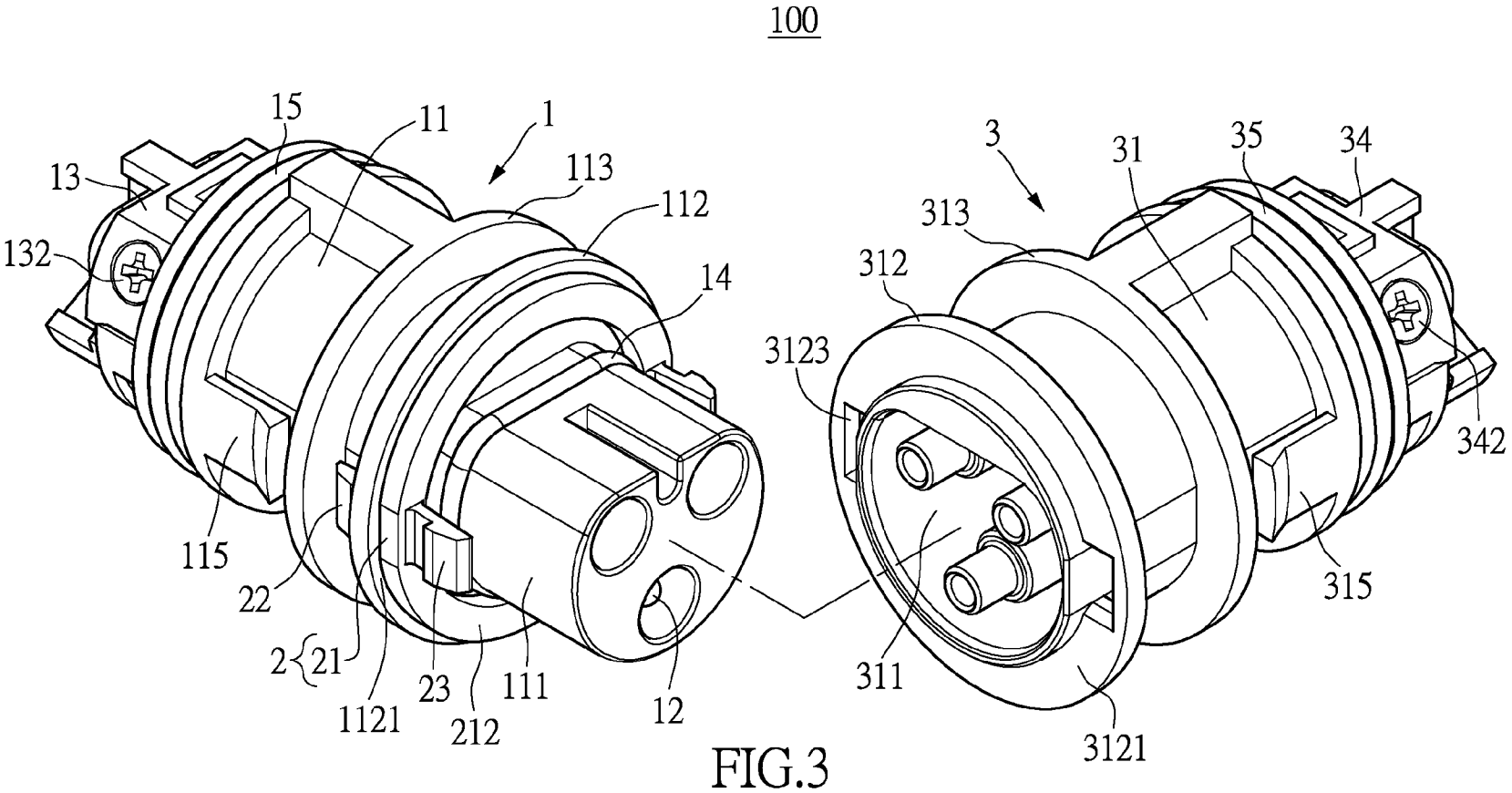
FIG. 3 is an exploded view of FIG. 1.

Referring to FIG. 1 to FIG. 3, the present disclosure provides a waterproof connector device assembly 100 for transmitting signals and power. However in practice the embodiments are not limited thereto. The waterproof connector device assembly 100 includes a plug connector 1, a snap ring 2 and a socket connector 3. The snap ring 2 can individually and detachably engage the plug connector 1 and the socket connector 3. The plug connector 1 and the socket connector 3 are connected and held together by the snap ring 2.

The following describes the structure of each of the components. It must be noted that the waterproof connector device of the present embodiment refers an assembly of the snap ring 2 and the plug connector 1, or an assembly of the snap ring 2 and the socket connector 3.

Figure 4:
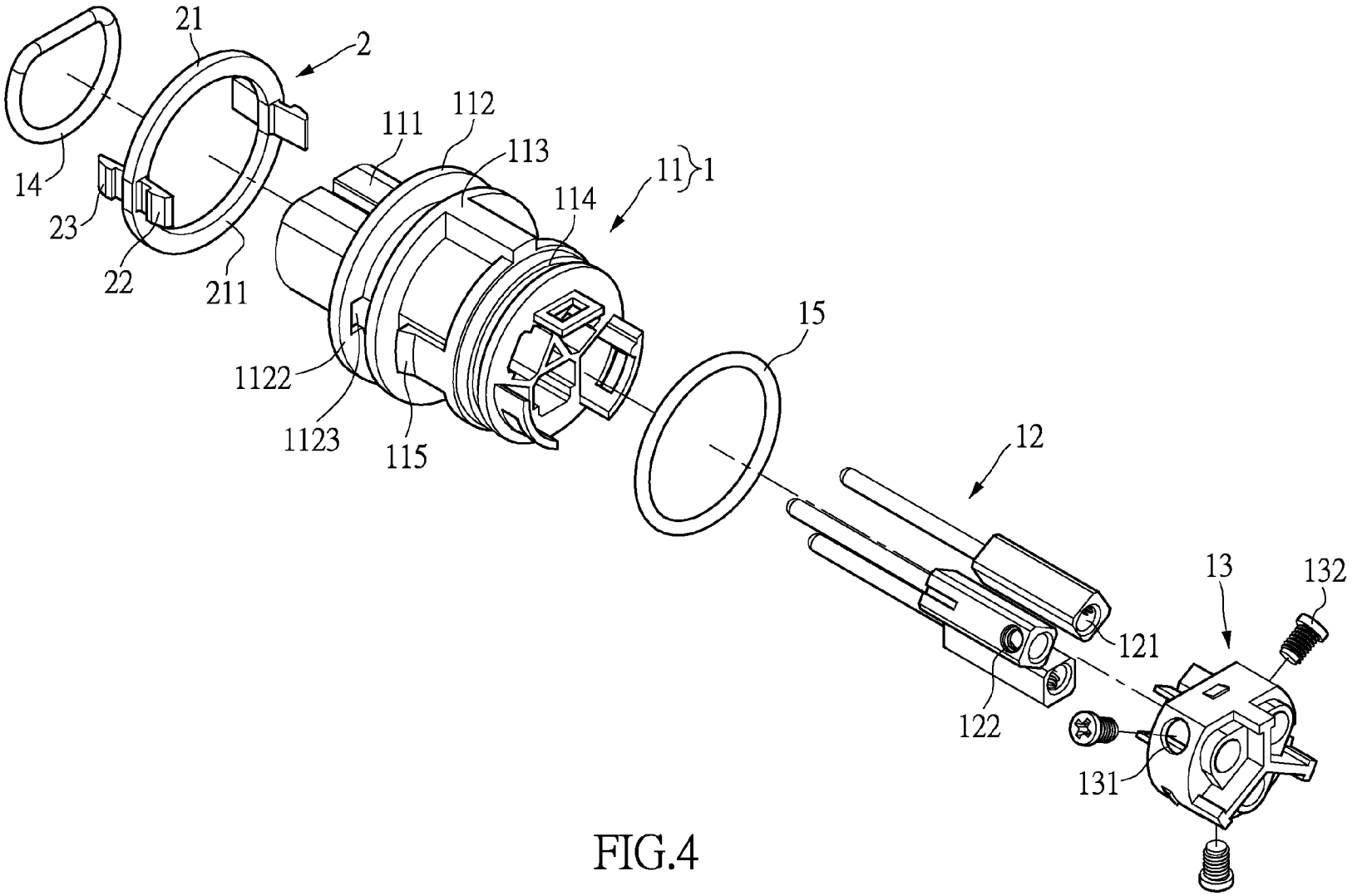
FIG. 4 shows an exploded view of a waterproof connector device according to the present disclosure.
Figure 5:
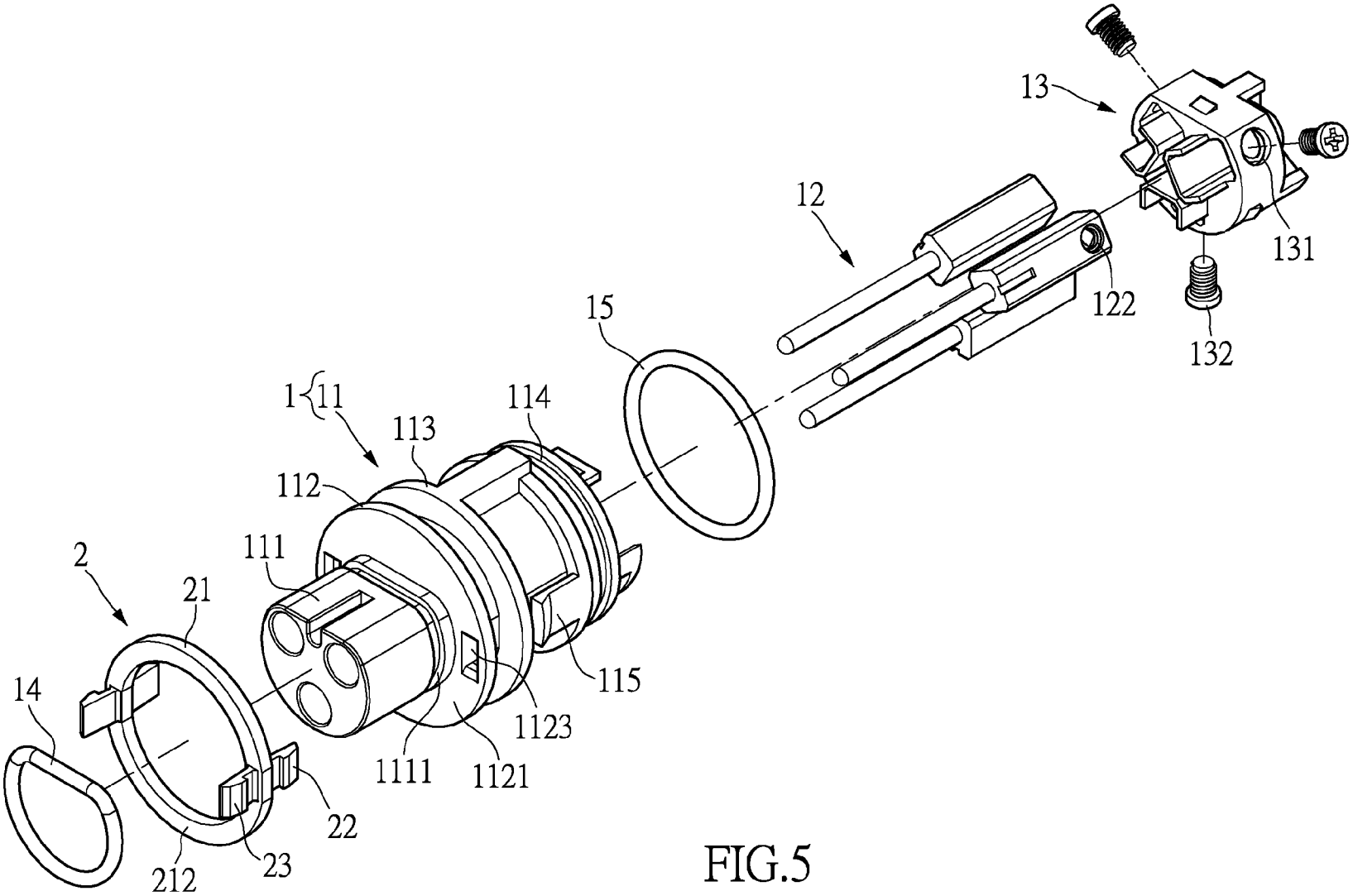
FIG. 5 shows an exploded view of the waterproof connector device from FIG. 4 from another perspective.

Referring to FIG. 4 and FIG. 5, the plug connector 1 has a plug main body 11 whose shape is column-like, a plurality of conductive terminals 12 disposed in the plug main body 11, a column-shaped wire connection portion 13 disposed at one end of the plug main body 11, a first sealing ring 14 disposed at the end of the plug main body 11 distal from the wire connection portion 13, a second sealing ring 15 disposed at the end of the plug main body 11 proximal to the wire connection portion 13, and a wire device 16 which is hollow and column-shaped and is connected to the plug main body 11.

The plug main body 11 has a plugging column 111. The plugging column 111 is substantially cylindrical and is formed with a first groove 1111. An annular retaining portion 112 extends integrally as one body from the bottom edge of the plugging column 111. The retaining portion 112 has a front surface 1121 proximal to the plugging column 111 and a rear surface 1122 distal from the plugging column 111. A plurality of through holes 1123 passing through the front surface 1121 and the rear surface 1122 are formed on the retaining portion 112.

Specifically, the plug main body 11 has an annular structure 113 formed by extending integrally as one body from the portion of the plug main body 11 proximal to the rear surface 1122. A predetermined distance is defined between the annular structure 113 and the retaining portion 112. The shape of the annular structure 113 corresponds to the shape of the retaining portion 112. The annular structure 113 and the retaining portion 112 are each integrally formed as one body with and extend from the plug main body 11.

The end of the plug main body 11 distal from the plugging column 111 has a second groove 114 and a plurality of snap arms 115. Specifically, the snap arms 115 are arranged between the annular structure 113 and the second groove 114. The snap arms 115 extend integrally as one body from a portion close to the second groove 114 toward the plugging column 111.

A plurality of conductive terminals 12 are disposed in the plug main body 11. The conductive terminals 12 are partially inserted in the plugging column 111 and partially exposed from the plugging column 111. The end of each of the conductive terminals 12 distal from the plugging column 111 is formed with a wire hole 121, and a screw hole 122 is formed perpendicular to and in fluid communication with the wire hole 121. The wire hole 121 can accommodate a wire therein (not shown in the figures). The conductive terminals 12 can be used to transmit signals or electrical power.

The wire connection portion 13 is arranged at the end of the plug main body 11 distal from the plugging column 111. The wire connection portion 13 is formed with a plurality of perforations 131. The shape of the perforations 131 respectively correspond to the shape of the screw holes 122. Each of the screw holes 122 is used to provide fixture to a screw 132, such that the wire arranged in the wire hole 121 is pressed by the screw 132 and achieves electrical connection with the conductive terminal 12.

The first sealing ring 14 sleeves the first groove 1111 of the plug column 111 proximal to the retaining portion 112. The first sealing ring 14 partially protrudes from the first groove 1111. The second sealing ring 15 sleeves the second groove 114 of the plug main body 11. The second sealing ring 15 partially protrudes from the second groove 114. The first sealing ring 14 and the second sealing ring 15 can be made of flexible and waterproof material such as silicone or rubber.

Figure 8:
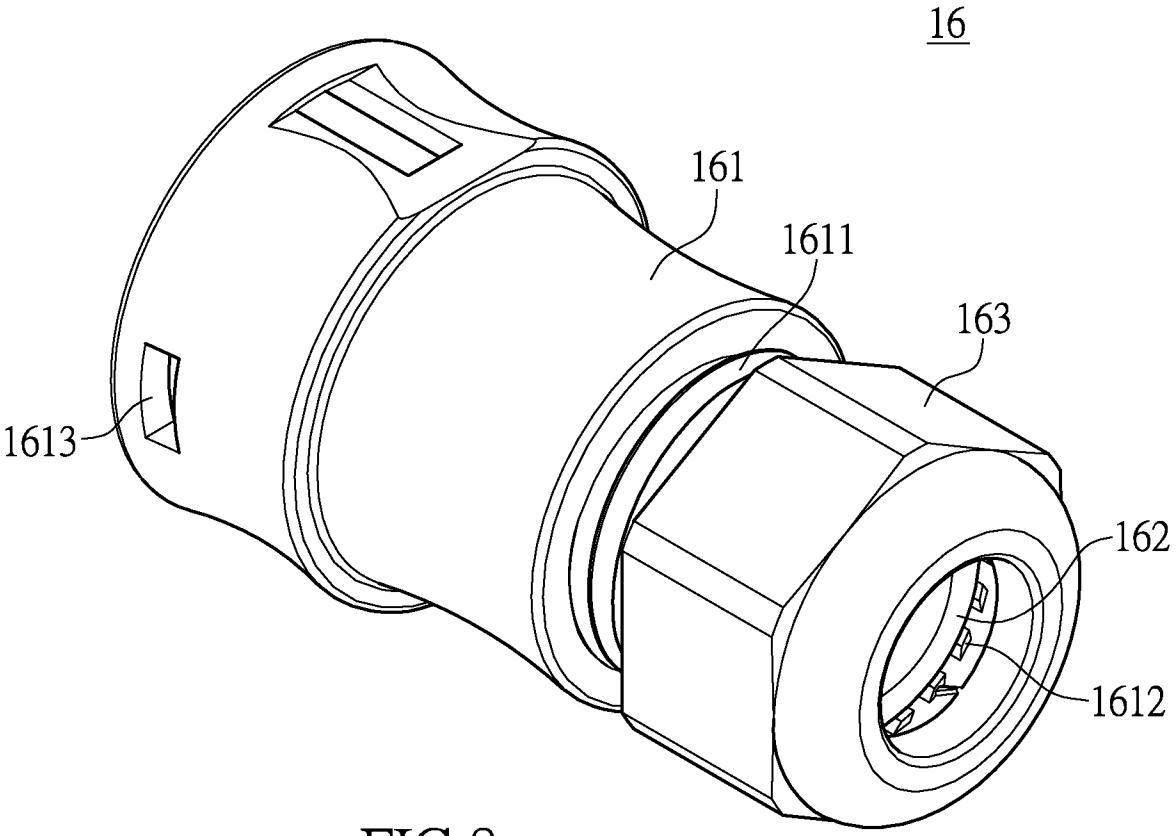
FIG. 8 shows a perspective view of a wire device of a waterproof connector device assembly according to the present disclosure.
Figure 9:
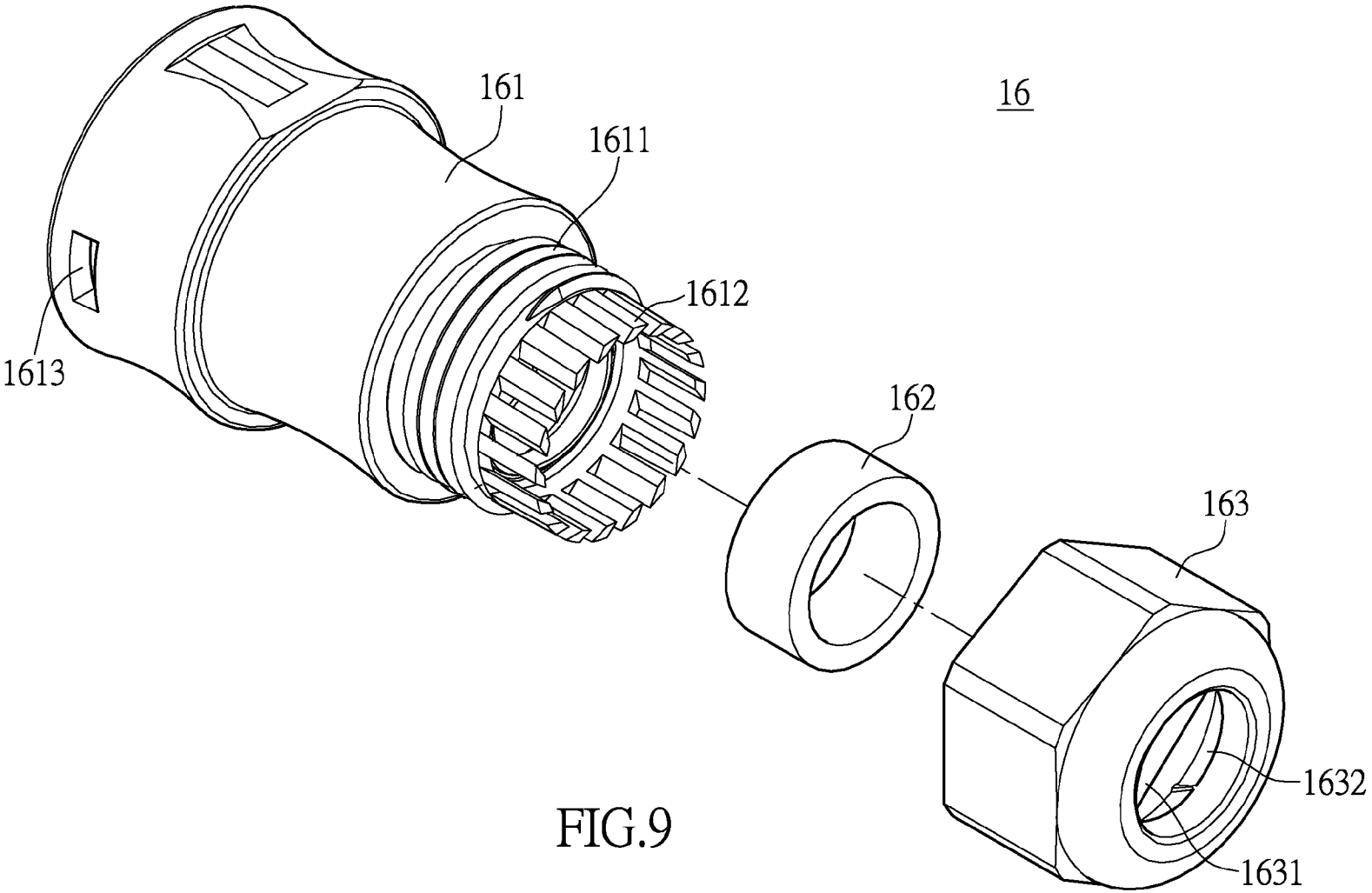
FIG. 9 is an exploded view of FIG. 8.

Referring to FIG. 8 and FIG. 9, the shape of the wire device 16 is hollow, for accommodating wires therein. The wire device 16 includes a wire device main body 161, a sealing unit 162 and a screw cap 163. One end of the wire device main body 161 is formed with a screw thread portion 1611 and a tightening portion 1612 connected to the screw thread portion 1611. The other end of the wire device main body 161 is formed with a plurality of engagement holes 1613. The sealing unit 162 is positioned at the inner edge of the tightening portion 1612. The inner edge of the screw cap 163 is formed with a screw thread 1631 and a curved face 1632. The screw thread 1631 of the screw cap 163 spins about the screw thread portion 1611 and is arranged thereat. During the screwing of the screw cap 163 to the screw thread portion 1611, the curved face 1632 movably presses the tightening portion 1612 and the sealing unit 162, such that the tightening portion 1612 and the sealing unit 162 press inward on the wire disposed in the wire device 16.

Referring to FIG. 3 to FIG. 5, the snap ring 2 is annular. The snap ring 2 has an annular main body 21, a plurality of first snap arms 22 and a plurality of second snap arms 23. The annular main body 21 has a first surface 211 and a second surface 212 opposite each other. The first snap arms 22 each extends integrally as one body from the first surface 211, the second snap arms 23 each extends integrally as one body from the second surface 212, and the directions of extensions of the first snap arms 22 and the second snap arms 23 are substantially opposite.

Specifically, the first snap arms 22 and the second snap arms 23 are positioned at corresponding locations on the first surface 211 and the second surface 212, respectively. The quantity of the first snap arms 22 is equal to the quantity of the second snap arms 23. The first snap arms 22 are substantially perpendicular to the first surface 211. The second snap arms 23 are substantially perpendicular to the second surface 212. The quantity of the first snap arms 22 is not greater than the quantity of the through holes 1123 of the retaining portion 112. Preferably, the quantity of the first snap arms 22 is equal to the quantity of the through holes 1123 of the retaining portion 112. In the present embodiment, the quantity of the first snap arms 22 and the quantity of the second snap arms 23 each are two, but the present disclosure is not limited thereto in practice.

The first snap arms 22 of the snap ring 2 can individually and detachably pass through the through holes 1123 of the retaining portion 112 from the front surface 1121 thereof, and substantially abut the rear surface 1122 of the retaining portion 112 for fixing the relative position of the snap ring 2 to the plug connector 1. The portions of the first snap arms 22 passed through the corresponding through holes 1123 are positioned between the retaining portion 112 and the annular structure 113, and the height of the second snap arms 23 with respect to the front surface 1121 is not greater than the height of the plugging column 111 with respect to the front surface 1121. By this configuration, the first snap arms 22 can be protected from outside force.

Figure 6:
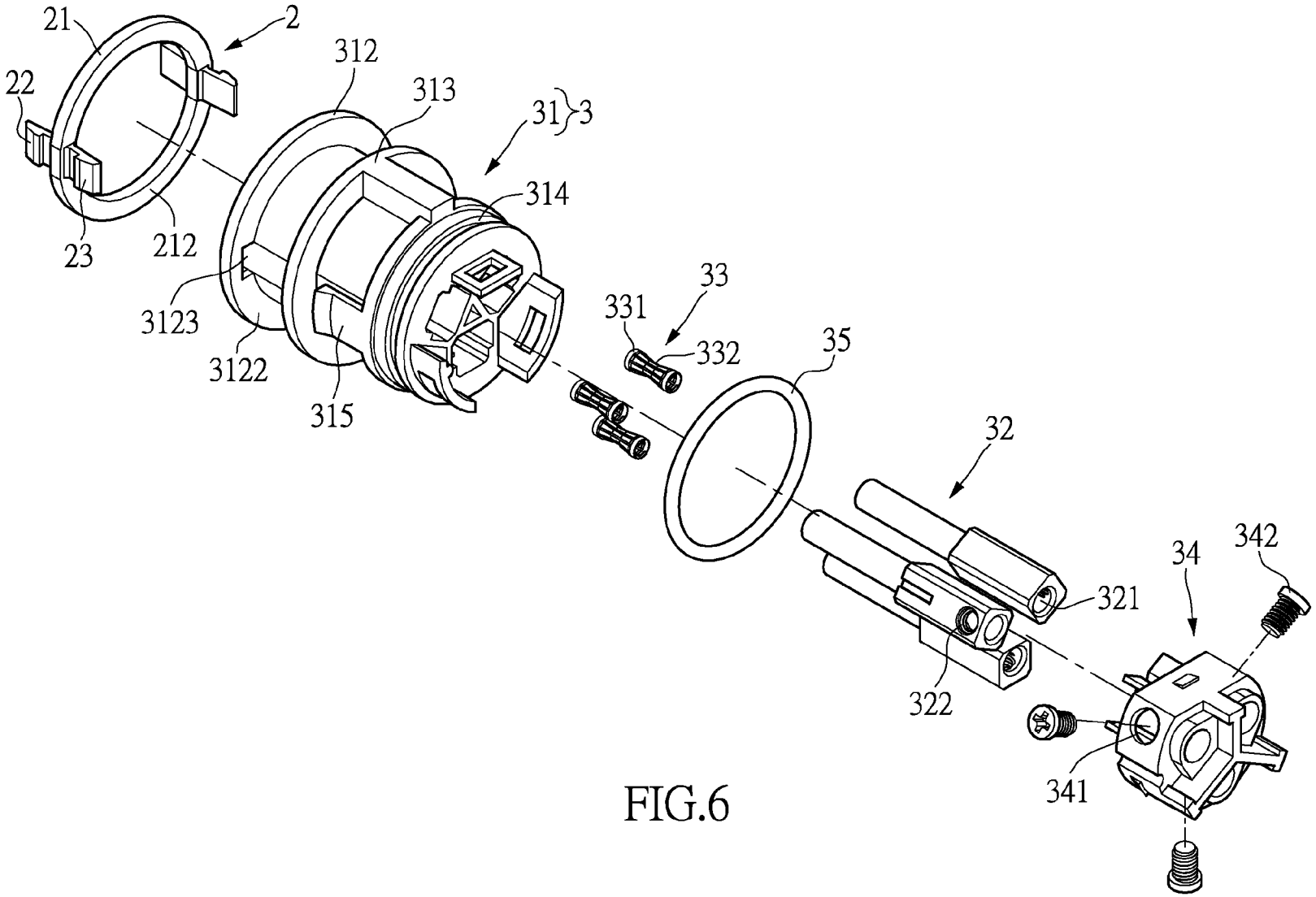
FIG. 6 shows an exploded view of another waterproof connector device according to the present disclosure.
Figure 7:
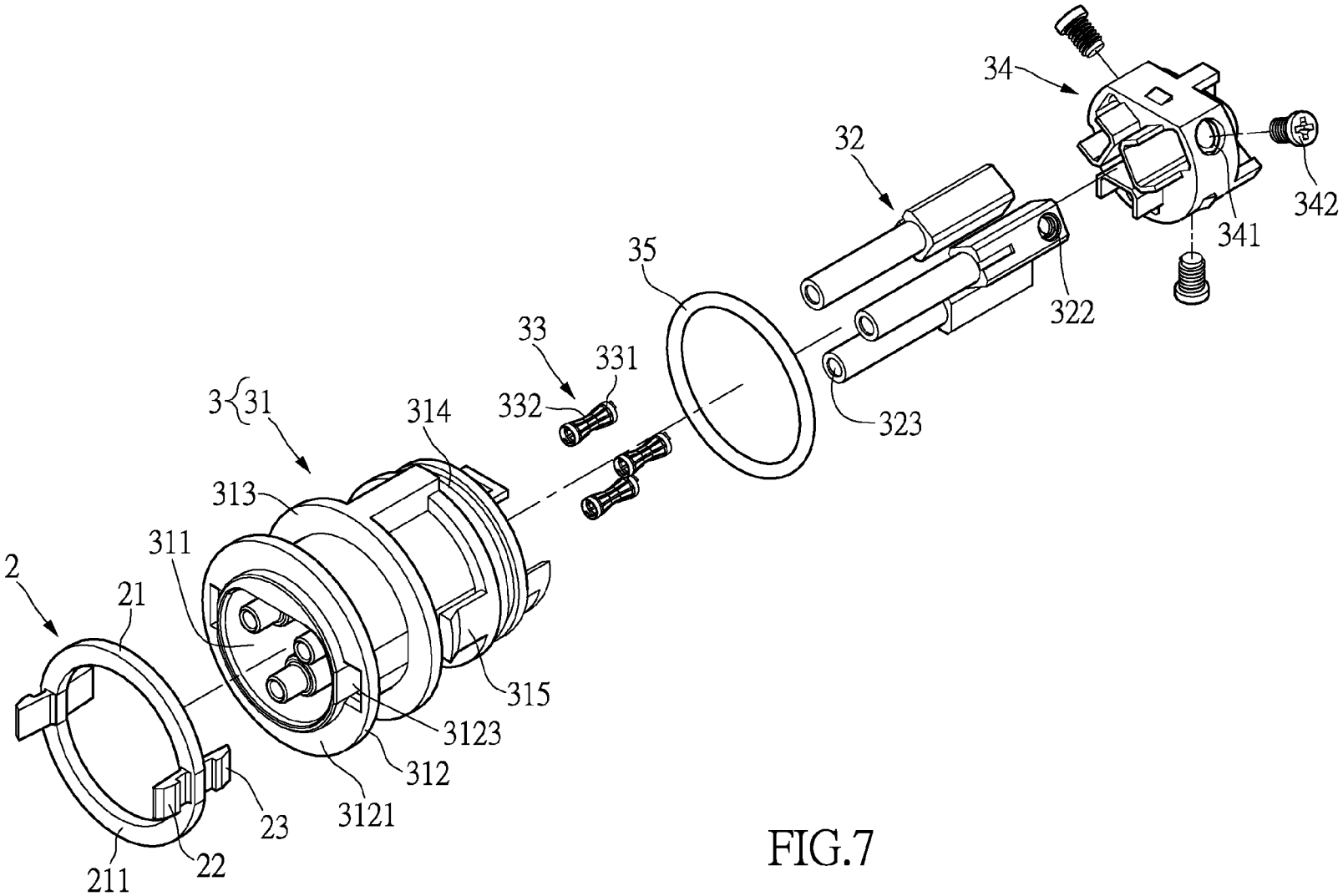
FIG. 7 shows an exploded view of the waterproof connector device from FIG. 6 from another perspective.
Figure 11:
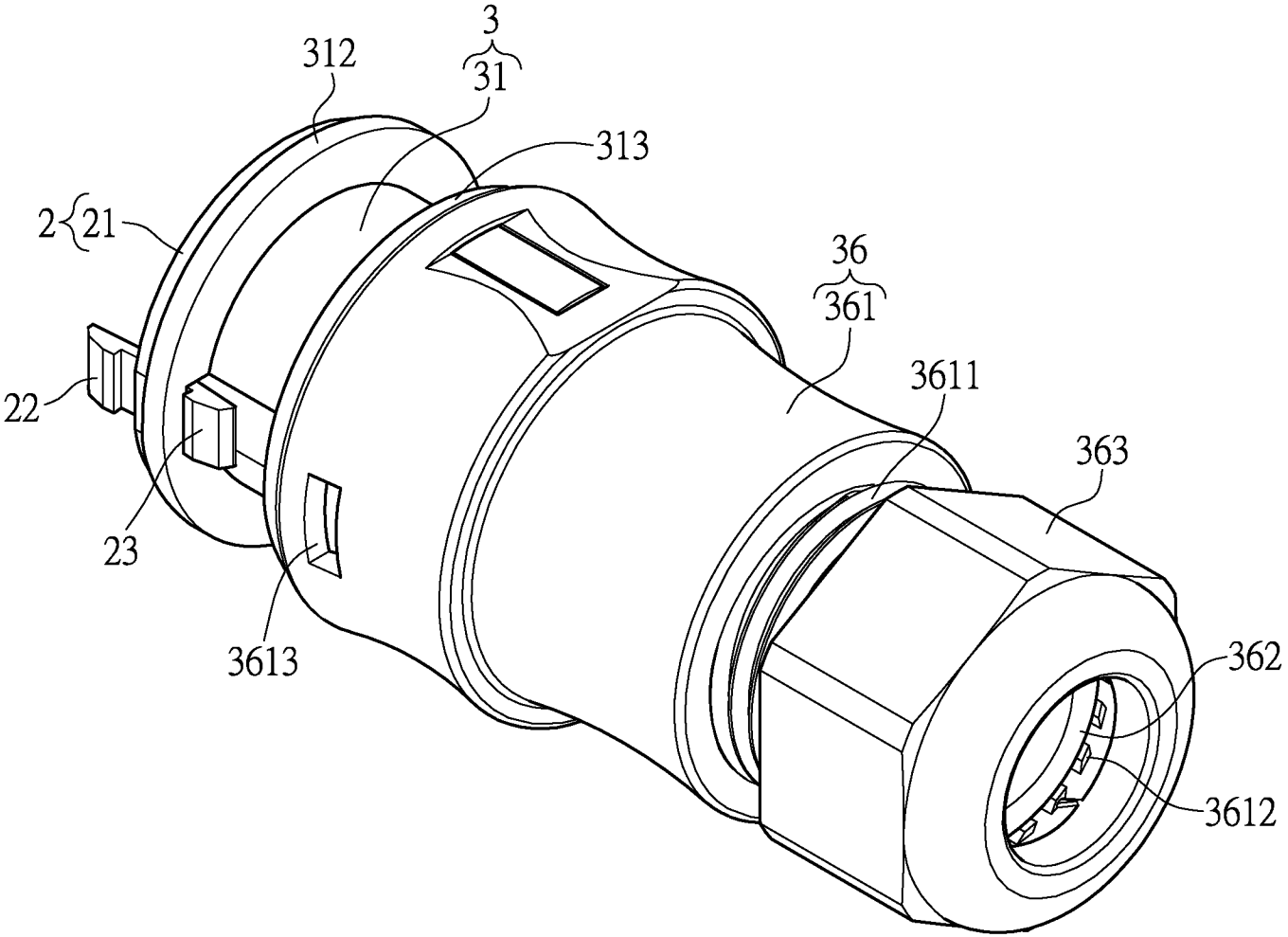
FIG. 11 shows a perspective view of the waterproof connector device of FIG. 6 fitted with a wire device according to the present disclosure.

Referring to FIG. 6 and FIG. 7, the socket connector 3 has a socket main body 31 which is substantially column-shaped, a plurality of conductive terminals 32 disposed in the socket main body 31, a plurality of tubular elastic units 33 respectively installed on the conductive terminals 32, a wire connection portion 34 which is column-shaped and arranged at one end of the socket main body 31, a sealing ring 35 which is annular and arranged the end of the socket main body 31 proximal to the wire connection portion 34, and a wire device 36 which is hollow, column-shaped and connected to the socket main body 31 (refer to FIG. 11). The structure of the wire device 36 is similar to that of the wire device 16, and is not further detailed herein.

The socket main body 31 has a plugging slot 311 and an annular retaining portion 312 extending integrally as one body from the front edge of the plugging slot 311. The retaining portion 312 has a front surface 3121 proximal to the opening of the plugging slot 311 and a rear surface 3122 distal from the opening of the plugging slot 311, and a plurality of through holes 3123 passing through the front surface 3121 and the rear surface 3122 are formed on the retaining portion 312.

Specifically, the socket main body 31 has an annular structure 313 formed by extending integrally as one body from the portion of the socket main body 31 proximal to the rear surface 3122. A predetermined distance is defined between the annular structure 313 and the retaining portion 312. The shape of the annular structure 313 corresponds to the shape of the retaining portion 312. The annular structure 313 and the retaining portion 312 are each integrally formed as one body with and extend from the socket main body 31.

The end of the socket main body 31 distal from the plugging slot 311 has a groove 314 and a plurality of snap arms 315. Specifically, the snap arms 315 are arranged between the annular structure 313 and the groove 314. The snap arms 315 extend integrally as one body from a portion close to the second groove 314 toward the plugging slot 311.

A plurality of conductive terminals 32 are disposed in the socket main body 31. The conductive terminals 32 are arranged in the plugging slot 311. The end of each of the conductive terminals 32 distal from the plugging slot 311 is formed with a wire hole 321 and a screw hole 322. The screw hole 322 is formed perpendicular to and in fluid communication with the wire hole 321. The wire hole 321 can accommodate a wire therein (not shown in the figures). The end of each of the conductive terminals 32 proximal to the plugging slot 311 is formed with an insertion hole 323. The conductive terminals 32 can be used to transmit signals or electrical power.

A plurality of elastic units 33 are disposed in the insertion holes 323. Each of the elastic units 33 has two annular fixing portions 331 and a plurality of elastic plates 332 arranged between the two fixing portions 331. Each of the elastic plates 332 is elongated and connected to the two fixing portions 331 at two ends respectively. Any two neighboring elastic plates 332 have a gap therebetween. The elastic plates 332 provide an elastic force. The area enclosed by the elastic plates 332 gradually increases from the middle to the fixing portions 331 at the two sides. The fixing portions 331 of the elastic units 33 can be coupled or welded to the conductive terminals 12, but the present disclosure is not limited thereto.

The wire connection portion 34 is arranged at the end of the socket main body 31 distal from the plugging slot 311. The wire connection portion 34 is formed with a plurality of perforations 341. The shape of the perforations 341 respectively correspond to the shape of the screw holes 322. Each of the screw holes 322 is used to provide fixture to a screw 342, such that the wire arranged in the wire hole 321 is pressed by the screw 342 and achieves electrical connection with the conductive terminal 32.

The sealing ring 35 sleeves the groove 314 of the socket main body 31. The sealing ring 35 partially protrudes from the groove 314. The sealing ring 35 can be made of flexible and waterproof material such as silicone or rubber.

The quantity of the second snap arms 23 of the snap ring 2 is not greater than the quantity of the through holes 3123 of the socket connector 3. Preferably, the quantity of the second snap arms 23 is equal to the quantity of the through holes 3123 of the retaining portion 312.

The second snap arms 23 of the snap ring 2 can individually and detachably pass through the through holes 3123 of the socket main body 31 from the front surface 3121 thereof, and substantially abut the rear surface 3122 of the socket main body 31 for fixing the relative position of the snap ring 2 to the socket connector 3. The portions of the second snap arms 23 passed through the corresponding through holes 3123 are positioned between the retaining portion 312 and the annular structure 313. By this configuration, the second snap arms 23 can be protected from outside force. The first snap arms 22 and the second snap arms 23 of the snap ring 2 can be respectively snapped to the retaining portion 112 of the plug connector 1 and the retaining portion 312 of the socket connector 3.

Referring to FIG. 1 and FIG. 3, when the waterproof connector device assembly 100 is to be used, the first snap arms 22 can be snapped to the retaining portion 112 of the plug connector 1 first, or the second snap arms 23 can be snapped to the retaining portion 312 of the socket connector, the order of which is not limited.

In the present embodiment, the first snap arms 22 pass through the through holes 1123 from the front surface 1121 of the plug main body 11. After the first snap arms 22 passes through the respective through holes 1123 and abut the rear surface 1122 of the plug main body 11, the plugging column 111 of the plug connector is plugged to the plugging slot 311 of the socket connector 3, such that the conductive terminals 12 of the plug connector 1 are connected to the conductive terminals 32 of the socket connector 3.

Specifically, the conductive terminals 12 of the plug connector 1 are inserted into the elastic units 33 of the socket connector 3. Given that the elastic plates 332 of the elastic units 33 have elasticity, and that the area enclosed by the midsection of the elastic plates 332 is slightly smaller than the cross-sectional area of the conductive terminals 12, when the conductive terminals 12 of the plug connector 1 are inserted between the elastic plates 332, the pressure and area of contact between the conductive terminals 12 of the plug connector 1 and the conductive terminals 32 of the socket connector 3 is increased. Consequently, the conductive terminals 12 of the plug connector 1 can be securely plugged in the elastic units 33, and the conductive terminals 12 of the plug connector 1 is less easily separated from the elastic units 33 of the socket connector 3.

After the conductive terminals 12 of the plug connector 1 are plugged into the elastic units 33 of the socket connector 3, the second snap arms 23 pass through the through holes 3123 of the socket main body 31 from the front surface 3121 of the socket connector 3 and abut the rear surface 3122 of the socket main body 31, such that the plug connector 1 and the socket connector 3 have a fixed relative position and are not easily separated, achieving electrical connection. Additionally, through the pressing abuttal on the inner wall of the plugging slot 311 by the first sealing ring 124 disposed on the plugging column 111, humidity from the external environment is prevented from entering through the location of mating between the plugging column 111 and the plugging slot 311.

When the waterproof connector device assembly 100 is not to be used, a wrench can be employed (not shown in the figures) to press the first snap arms 22 inward, such that when the first snap arms 22 are separated from the rear surface 1122 of the plug connector 1, the plug connector 1 and the socket connector 3 can be separated.

The above describes the structure and the connection relationships of the components of the plug connector 1, the snap ring 2 and the socket connector 3. The following describes the connection between the plug main body 11 of the plug connector 1 and the wire device 16, and the connection between the socket main body 31 of the socket connector 3 and the wire device 36.

Figure 10:
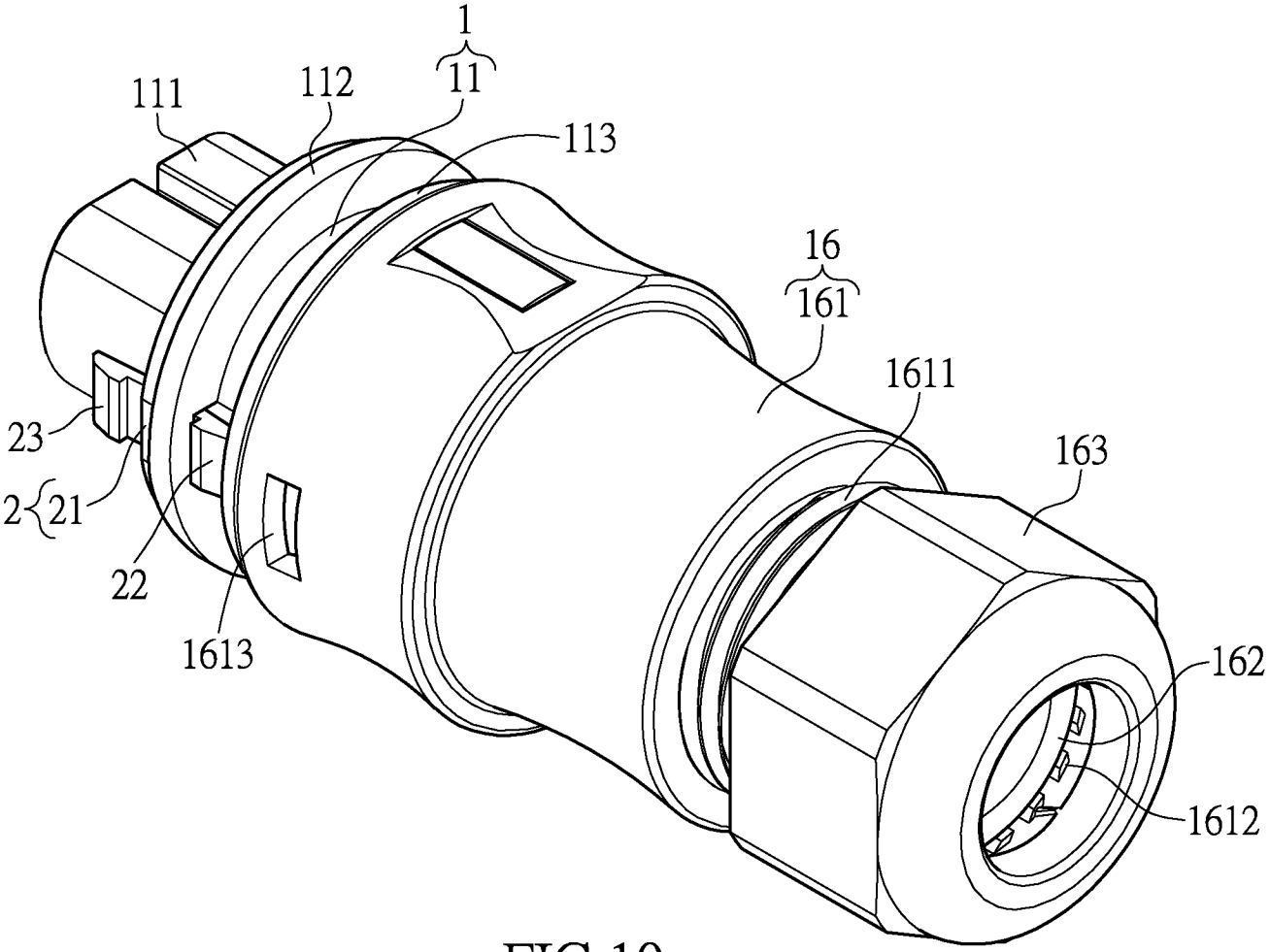
FIG. 10 shows a perspective view of the waterproof connector device of FIG. 4 fitted with a wire device according to the present disclosure.
Figure 12:
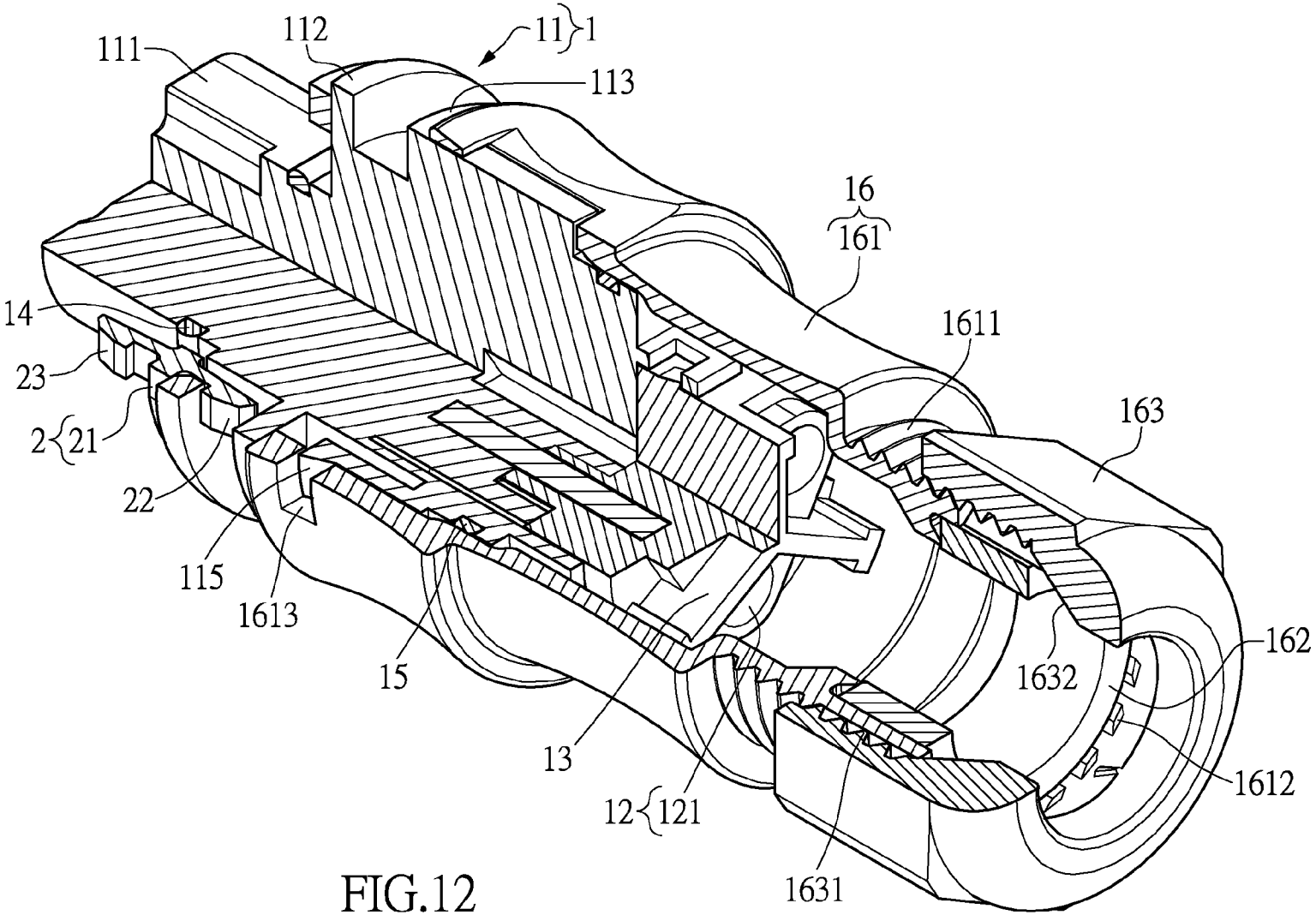
FIG. 12 is a cross-sectional view of FIG. 10.

Referring to FIG. 10 and FIG. 12, when the plug main body 11 and the wire device 16 are to be connected, one ends of the wires are inserted into the wire holes 121 of the conductive terminals 12, and then the screws 132 are screwed into the screw holes 122 for pressing the wires into electrical contact with the conductive terminals 12, and then the wires are inserted in the wire device 16, and then the snap arms 115 of the plug main body 11 are snapped to the engagement holes 1613 connected to the wire device 16. Additionally, through the second sealing ring 15 disposed on the plug main body 11, humidity in the external environment is prevented from entering through the connection portion between the plug main body 11 and the wire device 16.

At this moment, the screw thread 1631 of the screw cap 163 engages the screw thread portion 1611. As the screw cap 163 spinningly engages the screw thread portion 1611, the curved face 1632 can continue to movably press the tightening portion 1612 and the sealing unit 162, such that the tightening portion 1612 and the sealing unit 162 press inward on the wires arranged in the wire device 16, achieving prevention of loosening of the wire.

Figure 13:
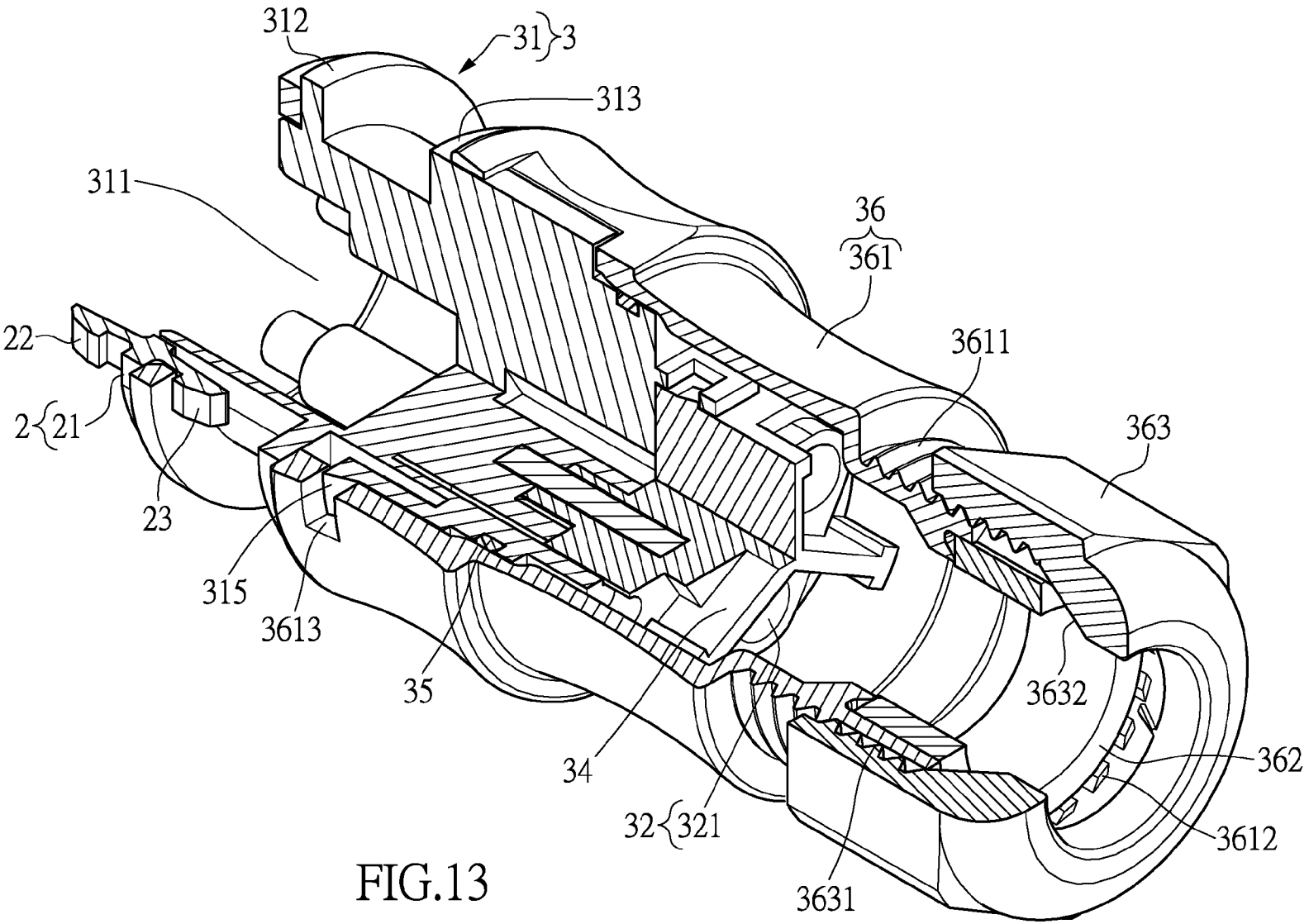
FIG. 13 is a cross-sectional view of FIG. 11.

Referring to FIG. 11 and FIG. 13, when the socket main body 31 and the wire device 36 are to be connected, one ends of the wires are inserted into the wire holes 321 of the conductive terminals 321, and then the screws 342 are screwed into the screw holes 322 for pressing the wires into electrical contact with the conductive terminals 32, and then the wires are inserted in the wire device 36, and then the snap arms 315 of the socket main body 31 are snapped to the engagement holes 3613 connected to the wire device 36. Additionally, through the sealing ring 35 disposed on the socket main body 31, humidity in the external environment is prevented from entering through the connection portion between the socket main body 31 and the wire device 36.

At this moment, the screw thread 3631 of the screw cap 363 engages the screw thread portion 3611. As the screw cap 363 spinningly engages the screw thread portion 3611, the curved face 3632 can continue to movably press the tightening portion 3612 and the sealing unit 362, such that the tightening portion 3612 and the sealing unit 362 press inward on the wires arranged in the wire device 36, achieving prevention of loosening of the wire.

Second Embodiment

Figure 14:
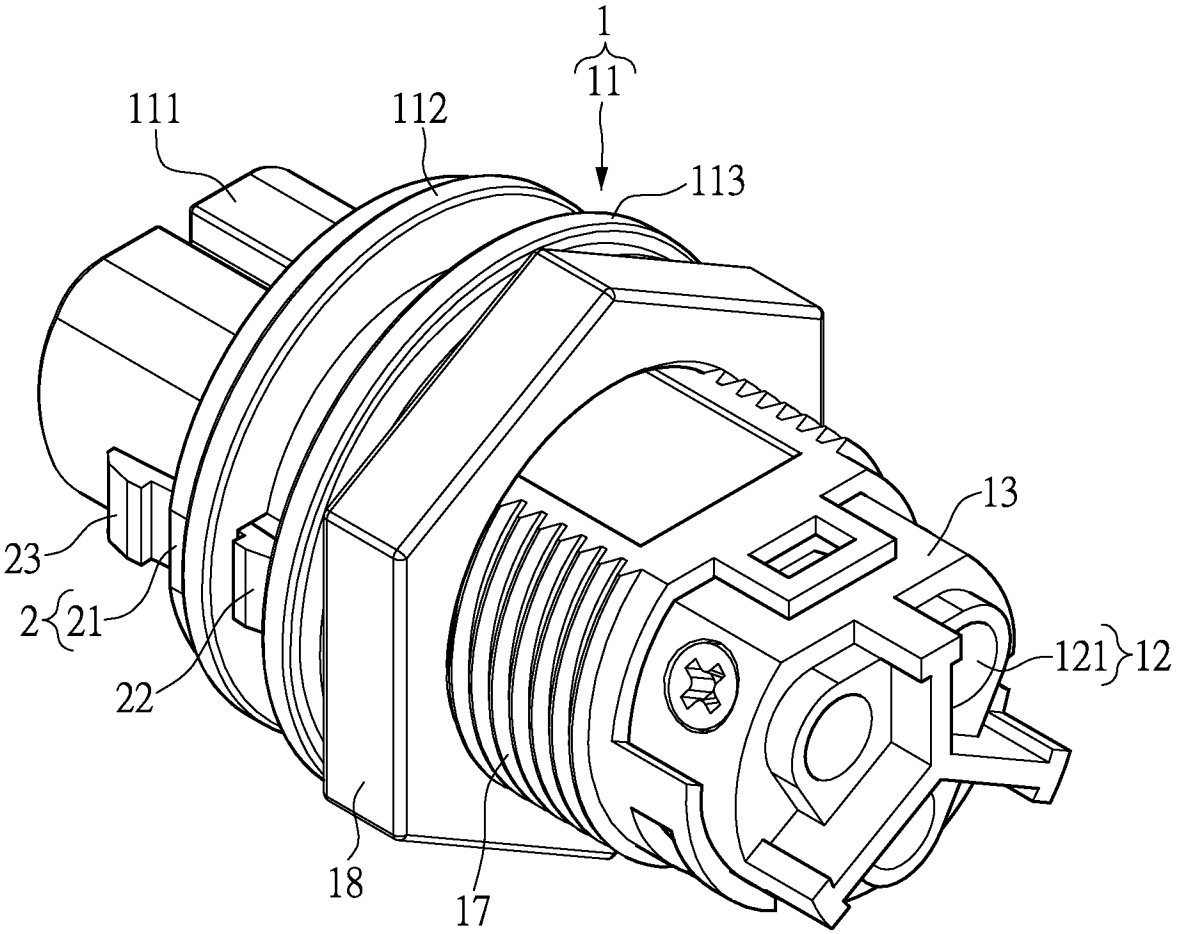
FIG. 14 shows a perspective view a plug connector according to another embodiment of the present disclosure.
Figure 15:
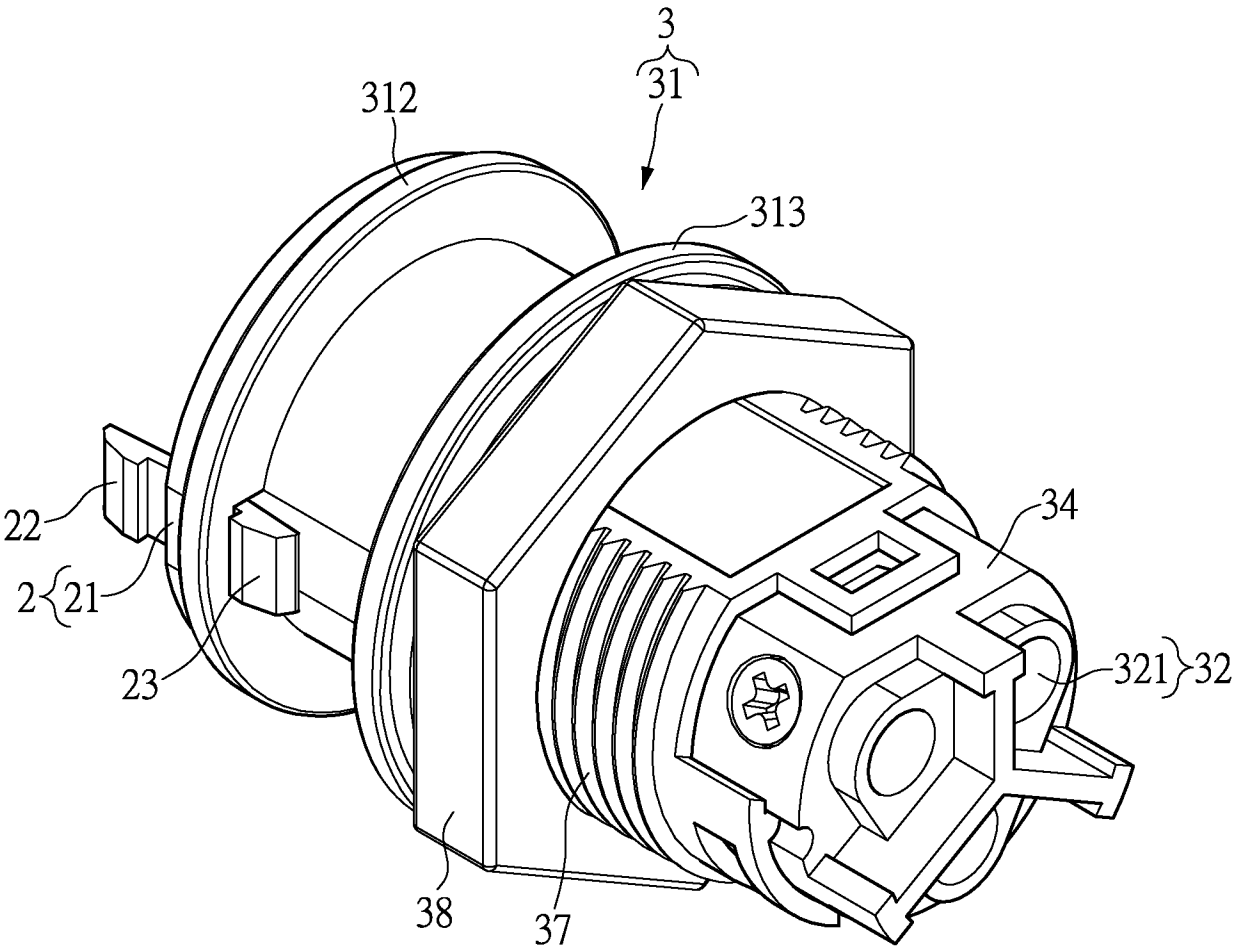
FIG. 15 shows a perspective view of a socket connector according to another embodiment of the present disclosure.

Referring to FIG. 14 and FIG. 15, the present embodiment and the first embodiment are similar, and the similarities are not further described. The difference between the present embodiment and the first embodiment lies in that the plug connector 1 does not have the snap arms 115 nor the wire device 16, and the socket connector 3 does not have the snap arms 315 nor the wire device 36. An external screw thread 17 can be formed on the plug connector 1 between the annular structure 113 and the wire connection portion 13. The plug connector 1 has a nut 18 which engages the external thread 17. Additionally an external screw thread 37 can be formed on the socket connector 3 between the annular structure 313 and the wire connection portion 34. The socket connector 3 has a nut 38 which engages the external thread 37.

Of supplemental note, the plug connectors 1 and the socket connectors 3 can be matched interchangeably. For example, the socket connector 1 of the first embodiment can be used with the socket connector 3 of the second embodiment.

[Potential Advantages of the Present Disclosure]

In summary of the above, the waterproof connector device provided by the present disclosure has a plug connector and a socket connector which when connected by a snap ring, the snap ring can fix the relative position of the plug connector and the socket connector, such that the plug connector and the socket connector are not easily separated for achieving electrical connection. Two ends of the plug connector and one end of the socket connector are each arranged with a sealing ring. When the plug connector is connected to the socket connector, humidity from the external environment is prevented from entering through the location of mating, achieving the effect of being waterproof.

After the first snap arms and the second snap arms of the present disclosure are passed through the respective through holes, the first snap arms and the second snap arms are positioned between the retaining portion and the annular structure. By this configuration, the first snap arms and the second snap arms can be protected from outside force. When the plug connector and the socket connector are to be separated, only a wrench is needed for pressing the snap arms inward and the plug connector and the socket connector can be separated.

The snap ring of the present disclosure is separate from the plug connector and the socket connector, such that the snap ring can be conveniently removed and snapped to the connectors or replaced. When the snap ring is aged or damaged, it only needs to be replaced individually, avoiding unnecessary waste.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A waterproof connector device, comprising:

a plug connector, including:

a plug main body having a plugging column and a retaining portion extending integrally as one body from the bottom edge of the plugging column, wherein the retaining portion has a front surface proximal to the plugging column and a rear surface distal from the plugging column, and a plurality of through holes passing through the front surface and the rear surface are formed on the retaining portion; and a plurality of conductive terminals disposed in the plug main body, wherein the conductive terminals are partially inserted in the plugging column and partially exposed from the plugging column; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, and the quantity of the first snap arms is not greater than the quantity of the through holes of the retaining portion;

wherein the first snap arms of the snap ring detachably pass through the through holes of the retaining portion from the front surface thereof, and substantially abut the rear surface of the retaining portion for fixing the relative position of the snap ring to the plug connector, and the height of the second snap arms with respect to the front surface is not greater than the height of the plugging column with respect to the front surface.

2. The waterproof connector device according to claim 1, wherein the plug connector includes a wire connection portion arranged at the end of the plug main body distal from the plugging column, the end of each of the conductive terminals distal from the plugging column is formed with a wire hole and a screw hole perpendicular to and in fluid communication with the wire hole, each wire hole is provided for accommodating a wire therein, the wire connection portion is formed with a plurality of perforations in fluid communication with the respective screw holes, the shape of the perforations respectively correspond to the shape of the screw holes, each of the screw holes provides fixture to one of the screws, and wherein when the wires are arranged in the wire holes, the wires are pressed by the screws to achieve electrical connection with the conductive terminals.

3. The waterproof connector device according to claim 2, wherein the plug connector includes a hollow wire device for accommodating the wires therein, the wire device includes a wire device main body, a sealing unit and a screw cap, one end of the wire device main body is formed with a screw thread portion and a tightening portion connected to the screw thread portion, the sealing unit is positioned at the inner edge of the tightening portion, the inner edge of the screw cap is formed with a screw thread and a curved face, the screw thread engages the screw thread portion, the curved face movably presses the tightening portion and the sealing unit for enabling the tightening portion and the sealing unit to press inward on the wires disposed in the wire device.

4. The waterproof connector device according to claim 3, wherein the portion of the plugging column proximal to the front surface has a first groove and a first sealing ring sleeving the first groove, the portion of the plug main body proximal to the bottom edge of the wire connection portion has a second groove, a second sealing ring and a plurality of snap arms, the second groove is arranged between the wire connection portion and the snap arms, the second sealing ring sleeves the second groove, the snap arms extend integrally as one body from close to the second groove toward the plugging column, the other end of the wire device main body is formed with a plurality of perforations, and the snap arms of the plug main body respectively and detachably snap to the perforations of the wire device main body.

5. A waterproof connector device, comprising:

a socket connector, including:

a socket main body having a plugging slot and a retaining portion extending integrally as one body from the outer surface of the plugging slot, wherein the retaining portion has a front surface and a rear surface, and a plurality of through holes passing through the front surface and the rear surface are formed on the retaining portion; and a plurality of conductive terminals disposed in the socket main body, wherein the conductive terminals are arranged in the plugging slot; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, and the quantity of the second snap arms is not greater than the quantity of the through holes of the retaining portion;

wherein the second snap arms of the snap ring detachably pass through the through holes of the retaining portion from the front surface thereof, and substantially abut the rear surface of the retaining portion for fixing the relative position of the snap ring to the socket connector.

6. The waterproof connector device according to claim 5, wherein the socket main body includes a plurality of tubular elastic units, each of the elastic units has two annular fixing portions and a plurality of elastic plates arranged between the two fixing portions, each of the elastic plates is elongated and integrally connected to the two fixing portions at two ends respectively, any two neighboring elastic plates have a gap therebetween, the elastic plates provide an elastic force, an area enclosed by the elastic plates gradually increases from the middle to the fixing portions at the two sides, the end of each of the conductive terminals is formed with an insertion hole, and the elastic units are respectively disposed in the insertion holes of the conductive terminals.

7. The waterproof connector device according to claim 5, wherein the socket connector includes a hollow wire device for accommodating wires therein, the wire device includes a wire device main body, a sealing unit and a screw cap, one end of the wire device main body is formed with a screw thread portion and a tightening portion connected to the screw thread portion, the sealing unit is positioned at the inner edge of the tightening portion, the inner edge of the screw cap is formed with a screw thread and a curved face, the screw thread engages the screw thread portion, the curved face movably presses the tightening portion and the sealing unit for enabling the tightening portion and the sealing unit to press inward on the wires disposed in the wire device.

8. A waterproof connector device assembly, comprising:

a plug connector, including:

a plug main body having a plugging column and a retaining portion extending integrally as one body from the bottom edge of the plugging column, wherein the retaining portion has a front surface proximal to the plugging column and a rear surface distal from the plugging column, and a plurality of through holes passing through the front surface and the rear surface are formed on the retaining portion; and a plurality of conductive terminals disposed in the plug main body, wherein the conductive terminals are partially inserted in the plugging column and partially exposed from the plugging column;

a socket connector, including:

a socket main body having a plugging slot and a retaining portion extending integrally as one body from the outer surface of the plugging slot, wherein the retaining portion has a front surface and a rear surface, and a plurality of through holes passing through the front surface and the rear surface are formed on the retaining portion; and a plurality of conductive terminals disposed in the socket main body, wherein the conductive terminals are arranged in the plugging slot; and a snap ring having an annular main body, a plurality of first snap arms and a plurality of second snap arms, wherein the annular main body has a first surface and a second surface opposite the first surface, the first snap arms each extends from the first surface, the second snap arms each extends from the second surface, the directions of extensions of the first snap arms and the second snap arms are substantially opposite, the quantity of the first snap arms is not greater than the quantity of the through holes of the plug connector, and the quantity of the second snap arms is not greater than the quantity of the through holes of the socket connector;

wherein the first snap arms and the second snap arms of the snap ring can respectively and detachably engage the retaining portion of the plug connector and the retaining portion of the socket connector, the first snap arms pass through the through holes of the plug main body from the front surface thereof, the second snap arms pass through the through holes of the socket main body from the front surface thereof, the first snap arms substantially abut the rear surface of the plug main body, the second snap arms substantially abut the rear surface of the socket main body, for fixing the relative position of the plug connector and the socket connector, and the plugging column of the plug connector is inserted into the plugging slot of the socket connector for achieving electrical connection.

9. The waterproof connector device assembly according to claim 8, wherein the quantity of the first snap arms is equal to the quantity of the through holes of the plug connector, and the quantity of the second snap arms is equal to the quantity of the through holes of the socket connector.

10. The waterproof connector device assembly according to claim 8, wherein the first snap arms and the second snap arms are formed on corresponding positions of the first surface and the second surface respectively, and the quantity of the first snap arms is equal to the quantity of the second snap arms.

* * * * *